US008674617B2

(12) United States Patent
Kumar et al.

(10) Patent No.: US 8,674,617 B2
(45) Date of Patent: Mar. 18, 2014

(54) MULTIPLE LIGHT LEVEL ELECTRONIC POWER CONVERTER

(75) Inventors: Nitin Kumar, Burlington, MA (US); Shashank Bakre, Woburn, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 301 days.

(21) Appl. No.: 13/077,063

(22) Filed: Mar. 31, 2011

(65) Prior Publication Data

US 2012/0248983 A1 Oct. 4, 2012

(51) Int. Cl.
*H05B 37/02* (2006.01)

(52) U.S. Cl.
USPC ..... 315/224; 315/210; 315/307; 315/308; 315/291

(58) Field of Classification Search
USPC ..... 315/247, 224, 291, 297, 307–326, 315/185 S; 345/102, 82, 76, 204, 211, 212, 345/213, 214
See application file for complete search history.

(56) References Cited

U.S. PATENT DOCUMENTS

| | | | | |
|---|---|---|---|---|
| 4,383,204 | A | 5/1983 | Roberts | |
| 4,963,795 | A | 10/1990 | Nilssn | |
| 5,309,062 | A | 5/1994 | Perkins et al. | |
| 5,831,395 | A | 11/1998 | Mortimer et al. | |
| 7,084,579 | B2 | 8/2006 | Konopka et al. | |
| 7,154,229 | B2 | 12/2006 | Alexandrov et al. | |
| 7,218,063 | B2 | 5/2007 | Konopka et al. | |
| 8,253,352 | B2 * | 8/2012 | Liu | 315/307 |
| 8,269,425 | B2 * | 9/2012 | Kawata et al. | 315/291 |
| 2006/0208669 | A1 * | 9/2006 | Huynh et al. | 315/312 |
| 2007/0182347 | A1 * | 8/2007 | Shteynberg et al. | 315/312 |
| 2009/0079355 | A1 * | 3/2009 | Zhou et al. | 315/246 |
| 2010/0164403 | A1 * | 7/2010 | Liu | 315/297 |

FOREIGN PATENT DOCUMENTS

| | | | |
|---|---|---|---|
| DE | 12 24 837 | B | 9/1966 |
| DE | 12 25 294 | B | 9/1966 |
| DE | 297 23 140 | U1 | 7/1998 |
| DE | 199 12 517 | A1 | 9/2000 |
| EP | 1 675 443 | A2 | 6/2006 |
| EP | 1 727 404 | A2 | 11/2006 |
| WO | 2010/031429 | A2 | 3/2010 |

OTHER PUBLICATIONS

Jose Hunckler, International Search Report and Written Opinion of the International Searching Authority, Aug. 7, 2012, pp. 1-10.

* cited by examiner

*Primary Examiner* — Alexander H Taningco
*Assistant Examiner* — Christopher Lo
(74) *Attorney, Agent, or Firm* — Shaun P. Montana

(57) ABSTRACT

A lighting system converter circuit of a lamp power converter to selectively operate a plurality of lamps connected thereto is provided. The lighting system converter circuit includes a first impedance circuit and a second impedance circuit. Each impedance circuit includes an input terminal, an impedance component, and a switching network. The impedance components are each configured to connect in series with the lamps. Each input terminal is configured to receive a control signal that indicates a state of a switch. Each control signal has a first logic level, indicating the switch is non-conductive, and a second logic level, indicating the switch is conductive. Each switching network is connected to its respective input terminal and in parallel with its respective impedance component, and is configured to selectively operate between a conductive state and a non-conductive state, as a function of the logic level of its respective control signal.

13 Claims, 5 Drawing Sheets

MULTIPLE LIGHT LEVEL ELECTRONIC POWER CONVERTER

TECHNICAL FIELD

The present invention relates to lighting, and more specifically, to lighting systems having multiple levels of light output.

BACKGROUND

Multiple level lighting systems, such as two or more level lighting systems, are used in various different lighting applications. For example, two level lighting systems are commonly used in overhead lighting. Such lighting systems can be used to conserve energy since they allow a portion of the lighting to be turned off when full light is not necessary. The lighting systems may be used to operate a variety of lamps, such as but not limited to gas discharge lamps, light emitting diode (LED) lamps, and other types of lamps.

A typical implementation of a two level lighting system includes two power switches and two power converters, wherein each power switch in the lighting system controls only one of the power converters in the lighting system. Turning on both of the switches at the same time powers both power converters, thus producing full light output from the lighting system. Turning on only one of the switches applies power to only one of the power converters in the lighting system and thus results in a reduced light level and a corresponding reduction in power consumed.

SUMMARY

Conventional lighting systems, such as those described above, are not as economical as a lighting system including only a single power converter. For compatibility purposes, the power converter would be required to operate from the same two power switches used in the two power converter system. When both switches are closed, the power converter would operate in a full light mode. Conversely, when only one of the two power switches is closed, the power converter would operate in a reduced light mode.

Embodiments of the present invention provide a multiple level lighting system using a single power converter. In particular, embodiments are directed to a power converter having a first switch and a second switch for selectively connecting the power converter, respectively, to a first power line and to a second power line. The power converter includes a lighting system converter circuit that provides voltage for energizing one or more lamps connected to the power converter, and a switch control circuit that generates control signals for the lighting system converter circuit based on the states of the first and second switches.

The magnitude of the voltage provided by the lighting system converter circuit varies so that the one or more lamps operate at multiple lighting levels. In one embodiment, the one or more lamps are operated at one of at least three lighting levels: full output, a first reduced level output, and a second reduced level output. The lighting system converter circuit varies the impedance in series with the one or more lamps in order to control the lighting levels.

In an embodiment, there is provided a lighting system converter circuit to selectively operate a plurality of lamps connected to a lamp power converter. The lamp power converter includes the lighting system converter circuit. The lighting system converter circuit includes a first impedance circuit and a second impedance circuit. The first impedance circuit includes: a first input terminal configured to receive a first control signal, wherein the first control signal indicates a state of a first switch, and wherein the first control signal has a first logic level and a second logic level, wherein the first logic level corresponds to the first switch being non-conductive and the second logic level corresponds to the first switch being conductive; a first impedance component configured to connect in series with the plurality of lamps; and a first switching network connected to the first input terminal and in parallel with the first impedance component, wherein the first switching network is configured to selectively operate between a conductive state and a non-conductive state as a function of the logic level of the first control signal. The second impedance circuit includes: a second input terminal configured to receive a second control signal, wherein the second control signal indicates a state of a second switch, and wherein the second control signal has a first logic level and a second logic level, wherein the first logic level corresponds to the second switch being non-conductive and the second logic level corresponds to the second switch being conductive; a second impedance component configured to connect in series with the plurality of lamps; and a second switching network connected to the second input terminal and in parallel with the second impedance component, wherein the second switching network is configured to selectively operate between a conductive state and a non-conductive state as a function of the logic level of the second control signal.

In a related embodiment, the first switching network may be configured to operate in a conductive state when the first control signal is at the second logic level, and to operate in a non-conductive state when the first control signal is at the first logic level. In another related embodiment, the second switching network may be configured to operate in a conductive state when the second control signal is at the second logic level, and to operate in a non-conductive state when the second control signal is at the first logic level. In yet another related embodiment, the first and second impedance components may include one or more capacitors.

In still another related embodiment, the first impedance component may have a first impedance value and the second impedance component may have a second impedance value, and the second impedance value may be greater than the first impedance value. In a further related embodiment, the lighting system converter circuit may be configured to provide a first voltage level to energize the plurality of lamps when the first switching component is conductive and the second switching component is non-conductive, and the lighting system converter circuit may be configured to provide a second voltage level to energize the plurality of lamps when the first switching component is non-conductive and the second switching component is conductive, and the second voltage level may be greater than the first voltage level. In another further related embodiment, the lighting system converter circuit may be configured to provide a first voltage level to energize the plurality of lamps when the first control signal is at the second logic level and the second control signal is at the first logic level, and the lighting system converter circuit may be configured to provide a second voltage level to energize the plurality of lamps when the first control signal is at the first logic level and the second control signal is at the second logic level, and the second voltage level may be greater than the first voltage level.

In yet another related embodiment, the lighting system converter circuit may be configured to operate the plurality of lamps at maximum brightness when the first switching component is conductive and the second switching component is conductive. In still yet another related embodiment, the lighting system converter circuit may be configured to operate the plurality of lamps at maximum brightness when the first control signal is at the second logic level and the second control signal is at the second logic level. In yet still another related embodiment, the first switching network may include: a first transistor having a drain terminal, a gate terminal, and a source terminal; and a second transistor having a drain terminal, a gate terminal, and a source terminal; wherein the gate terminal of the first transistor and the gate terminal of the second transistor may be connected to the first input terminal of the first impedance circuit to receive the first control signal therefrom; and the drain terminal of the first transistor may be connected to a first terminal of the first impedance component and the drain terminal of the second transistor may be connected to a second terminal of the first impedance component; and the second switching network may include: a third transistor having a drain terminal, a gate terminal, and a source terminal; and a fourth transistor having a drain terminal, a gate terminal, and a source terminal; wherein the gate terminal of the third transistor and the gate terminal of the fourth transistor may be connected to the second input terminal to receive the second control signal therefrom; and the drain terminal of the third transistor may be connected to a first terminal of the second impedance component and the drain terminal of the fourth transistor may be connected to a second terminal of the second impedance component.

In still yet another related embodiment, a first isolation transformer with biasing circuitry may be connected between the first input terminal and the first switching network, and a second isolation transformer with biasing circuitry may be connected between the second input terminal and the second switching network. In yet still another related embodiment, a first opto-isolator with biasing circuitry may be connected between the first input terminal and the first switching network, and a second opto-isolator with biasing circuitry may be connected between the second input terminal and the second switching network.

In another embodiment, there is provided a method performed by a lighting system converter circuit of a lamp power converter. The method includes: receiving a first control signal indicative of a state of a first switch, wherein the first control signal has a first logic level when the first switch is non-conductive and the first control signal has a second logic level when the first switch is conductive; receiving a second control signal indicative of a state of a second switch, wherein the second control signal has a first logic level when the second switch is non-conductive and the second control signal has a second logic level when the second switch is conductive; providing a first impedance in series with a plurality of lamps connected to the lamp power converter when the first control signal is at the first logic level; bypassing the first impedance from operating in series with the plurality of lamps connected to the lamp power converter when the first control signal is at the second logic level; providing a second impedance in series with the plurality of lamps connected to the lamp power converter when the second control signal has the first logic level, wherein the first impedance and the second impedance have different values; and bypassing the second impedance from operating in series with the plurality of lamps connected to the lamp power converter when the second control signal has the second logic level.

In a related embodiment, the method may further include: providing a first voltage level to the plurality of lamps when the first control signal is at the second logic level and the second control signal is at the first logic level; and providing a second voltage level to the plurality of lamps when the first control signal is at the first logic level and the second control signal is at the first logic level, wherein the second voltage level is greater than the first voltage level. In another related embodiment, the second impedance may be greater than the first impedance. In still another related embodiment, the first impedance may be greater than the second impedance.

In another embodiment, there is provided a lamp power converter to power a plurality of lamps connected thereto from an alternating current (AC) power supply. The lamp power converter includes: a first switch adapted to selectively connect the lamp power converter to a first high voltage terminal of the AC power supply, the first switch having an on state and an off state; a second switch adapted to selectively connect the lamp power converter to a second high voltage terminal of the AC power supply, the second switch having an on state and an off state; a switch control circuit to generate a first control signal and a second control signal, wherein the first control signal indicates a status of the first switch, and wherein the second control signal indicates a status of the second switch; and a lighting system converter circuit configured to provide a first impedance in series with the plurality of lamps when the first control signal indicates a first status of the first switch, and to provide a second impedance in series with the plurality of lamps when the second control signal indicates a first status of the second switch.

In a related embodiment, the lighting system converter circuit may include: a first impedance circuit including: a first input terminal configured to receive the first control signal from the switch control circuit; a first impedance component configured to connect in series with the plurality of lamps; and a first switching network connected to the first input terminal and in parallel with the first impedance component, wherein the first switching network is configured to selectively operate between a conductive state and a non-conductive state as a function of the status of the first switch as indicated by the first control signal; and a second impedance circuit including: a second input terminal configured to receive the second control signal from the switch control circuit; a second impedance component configured to connect in series with the plurality of lamps; and a second switching network connected to the second input terminal and in parallel with the second impedance component, wherein the second switching network is configured to selectively operate between a conductive state and a non-conductive state as a function of the status of the second switch as indicated by the second control signal.

In a further related embodiment, the lighting system converter circuit may further include: a first isolation and bias circuit connected between the switch control circuit and the first switching network; and a second isolation and bias circuit connected between the switch control circuit and the second switching network.

In another related embodiment, the lighting system converter circuit may be configured to provide a first voltage level to the plurality of lamps when the first control signal indicates a second status of the first switch and the second control signal indicates the first status of the second switch, and to provide a second voltage level to the plurality of lamps when the first control signal indicates the first status of the first switch and the second control signal indicates a second status of the second switch, wherein the second voltage level may be greater than the first voltage level.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
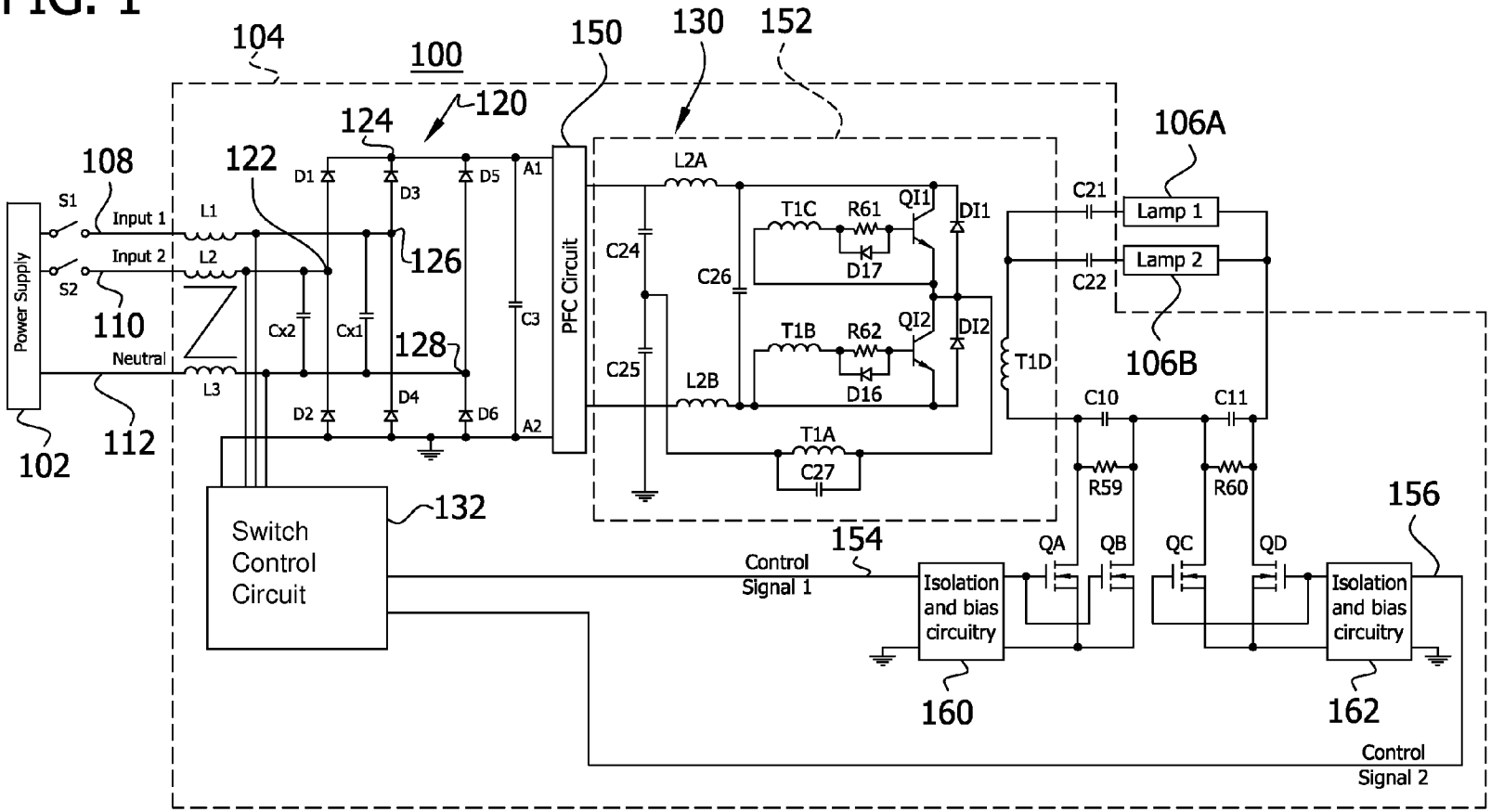
FIG. 1 shows a schematic diagram, partially in block form, of a lamp system according to embodiments disclosed herein.

FIG. 1 illustrates a lamp system 100 according to an embodiment of the invention. The lamp system 100 includes an input power source, such as but not limited to an alternating current (AC) power supply 102. The lamp system 100 also includes a power converter 104 (e.g., a ballast), and a plurality of lamps 106A, 106B connected together in parallel. In some embodiments, the plurality of lamps 106A, 106B may be connected in series. Although only two lamps 106A and 106B are shown in the lamp system 100 of FIG. 1, the lamp system 100 may include any number of lamps connected together parallel or in series. In some embodiments, one or more of the plurality of lamps 106A, 106B is a T8 fluorescent lamp available from OSRAM SYLVANIA, Philips, or General Electric. Of course, the lamp system 100 may be used to energize other types of lamps not specifically mentioned herein without departing from the scope of the invention.

The power converter 104 includes a first high voltage input terminal 108 (i.e., line voltage input terminal, hot input terminal) to be connected to a first high voltage terminal (e.g., hot wire) of the alternating current (AC) power supply 102 (e.g., standard 120V or 240V AC household power), and a second high voltage input terminal 110 (i.e., line voltage input terminal) to be connected to a second high voltage terminal of the AC power supply 102. The power converter 104 also includes a neutral input terminal 112 to be connected to a neutral wire of the AC power supply 102, and a ground terminal (not shown) connectable to ground potential. A first switch S1 is connected to the first high voltage input terminal 108. Accordingly, the first switch S1 is adapted to selectively connect the power converter 104 to the first high voltage terminal of the AC power supply 102. A second switch S2 is connected to the second high voltage input terminal 110. As such, the second switch S2 is adapted to selectively connect the power converter 104 to the second high voltage terminal of the AC power supply 102. The first switch S1 and the second switch S2 may be implemented by, for example but not limited to, conventional wall switches having an on state and an off state, among other possible states.

A rectifier circuit 120 is coupled to the first high voltage input terminal 108, the second high voltage input terminal 110, and the neutral terminal 112. In particular, the rectifier circuit 120 is coupled to the first high voltage input terminal 108 via a first electromagnetic interference (EMI) inductor L1. The rectifier circuit 120 is coupled to the second high voltage input terminal 110 via a second EMI inductor L2. The rectifier circuit 120 is coupled to the neutral terminal 112 via a third EMI inductor L3. As shown in FIG. 1, the rectifier circuit 120 is a full-wave rectifier implemented by an arrangement comprising a first diode D1, a second diode D2, a third diode D3, a fourth diode D4, a fifth diode D5, and a sixth diode D6. The first diode D1 has an anode coupled to a first node 122 and a cathode coupled to a second node 124. The first node 122 is coupled to the second high voltage input terminal 110 via the second EMI inductor L2. The second diode D2 has an anode coupled to ground potential and a cathode coupled to the first node 122. The third diode D3 has an anode coupled to a third node 126 and a cathode coupled to the second node 124. The third node 126 is coupled to first high voltage input terminal 108 via the first EMI inductor L1. The fourth diode D4 has an anode coupled to the ground potential and a cathode coupled to the third node 126. The fifth diode D5 has an anode coupled to a fourth node 128 and a cathode coupled to the second node 124. The fourth node 128 is coupled to the neutral input terminal 112 via the third EMI inductor L3. The sixth diode D6 has an anode coupled to ground potential and a cathode coupled to the fourth node 128.

A first EMI capacitor Cx1 is connected between the first high voltage input terminal 108 and the neutral terminal 112. A second EMI capacitor Cx2 is connected between the second high voltage input terminal 1 and the neutral terminal 112. Specifically, the first EMI capacitor Cx1 is connected between the third node 126 and the fourth node 128. The second EMI capacitor Cx2 is connected between the first node 122 and the fourth node 128. As shown in FIG. 1, a high frequency bypass capacitor C3 may be, and in some embodiments, is, connected between the fourth node 128 and the ground potential.

In operation, the power converter 104 selectively receives a sinusoidal AC voltage signal from the AC power supply 102 via the first switch S1 and/or the second switch S2. The first EMI inductor L1, the second EMI inductor L2, and the third EMI inductor L3, and the first EMI capacitor Cx1 and the second EMI capacitor Cx2 reduce high frequency noise generated by the power converter 104. The rectifier circuit 120 receives the AC voltage signal and generates a rectified voltage signal therefrom. The high frequency bypass capacitor C3 reduces high frequency noise in the rectified voltage signal. A lighting system converter circuit 130 is coupled to the rectifier circuit 120 via the high frequency bypass capacitor C3. The lighting system converter circuit 130 receives the rectified voltage signal and provides a voltage and current suitable to energize the plurality of lamps 106A, 106B. In some embodiments, such as is shown in FIG. 1, the lighting system converter circuit 130 may include a power factor correction circuit 150 and an inverter circuit 152. The inverter circuit 152 is formed by capacitors C24, C25, C26, and C27, windings L2A and L2B, which function as a current choke, transformer windings T1A, T1B, T1C, and T1D, diodes DI1, DI2, D16, and D17, resistors R61 and R62, and transistors QI1 and QI2. In some embodiments, the transformers windings T1A, T1B, T1C, and T1D are wound on one core, while the windings L2A and L2B are wound on another core. In some embodiments, a current limiting capacitor is connected in series with each lamp 106A and 106B, between the inverter 152 and each lamp 106A and 106 B. As shown in FIG. 1, a first current limiting capacitor C21 is connected in series with the first lamp 106A, between the inverter 152 and the first lamp 106A. Similarly, a second current limiting capacitor C22 is connected in series with the second lamp 106B, between the inverter 152 and the second lamp 106B.

The power converter 104 includes a switch control circuit 132 to provide control signals to the lighting system converter circuit 130 as a function of the states (e.g., statuses) of the first switch S1 and the second switch S2, according to any circuit known in the art to perform such functionality. In some embodiments, the first control signal (i.e., control signal 1) is a voltage signal having a magnitude (e.g., voltage level) that is dependent on the state (e.g., a status) of the first switch S1. The second control signal (i.e., control signal 2) is a voltage signal having a magnitude (e.g., voltage level) that is dependent on the state (e.g., a status) of the second switch S1. The first switch S1, in some embodiments, has a first status and a second status, each status indicating a state of the first switch S1. Similarly, the second switch S2, in some embodiments, has a first status and a second status, each status indicating a state of the second switch S2. In some embodiments, the first status of the first switch S1 is the same, or approximately the same, as the first status of the second switch S2. Similarly, in some embodiments, the second status of the first switch S2 is the same, or approximately the same, as the second status of the second switch S2. For example, as shown in FIG. 1, when the first switch S1 is in an off state, the magnitude of the first control signal is at a first level (e.g., low level, 0 volts), thus indicating a particular status of the first switch S1. When the first switch S1 is in the on state, the magnitude of the first control signal is at a second level (e.g., high level, 10 volts), thus indicating a particular status of the first switch S1. Similarly, when the second switch S2 is in an off state, the magnitude of the second control signal is at a first level (e.g., low level, 0 volts), thus indicating a particular status of the second switch S2. When the second switch S2 is in the on state, the magnitude of the second control signal is at a second level (e.g., high level, 10 volts), thus indicating a particular status of the second switch S2. In turn, the lighting system converter circuit 130 provides a voltage signal to the plurality of lamps 106A, 106B as a function of the first and second control signals. The plurality of lamps 106A, 106B generate a particular amount of light (e.g., lumens, lighting level) as a function of the voltage signal (e.g., voltage level, voltage magnitude) provided to the plurality of lamps 106A, 106B by the lighting system converter circuit 130.

The lighting system converter circuit 130 includes a first impedance circuit that provides a first impedance in series with the plurality of lamps 106A, 106B as a function of the first control signal. The lighting system converter circuit 130 also includes a second impedance circuit that provides a second impedance in series with the plurality of lamps 106A, 106B as a function of the second control signal. When impedance is added in series with the plurality of lamps 106A, 106B, the voltage level provided to the plurality of lamps 106A, 106B is reduced, and thus the amount of light generated by the plurality of lamps 106A, 106B is likewise reduced. As such, the lighting system converter circuit 130 is able to operate the plurality of lamps 106A, 106B at multiple lighting levels as a function of the states of the first and second switches S1 and S2.

In some embodiments, the first impedance circuit comprises a first input terminal 154, a first impedance component, such as but not limited to a capacitor C10, and a first switching network QA, QB. The first input terminal 154 is configured to receive the first control signal that indicates the state of the first switch S1. The capacitor C10 (broadly, the first impedance component) is configured to connect in series with the plurality of lamps 106A, 106B when the plurality of lamps 106A, 106B are connected to the power converter 104. In some embodiments, a bleeder resistor R59 is connected in parallel with capacitor C10. The first switching network QA, QB is connected to the first input terminal 154 and in parallel with the capacitor C10. In some embodiments, such as is shown in FIG. 1, the first switching network includes a first transistor QA and a second transistor QB. The first and second transistors QA and QB may be, but are not limited to, metal-oxide-semiconductor field-effect transistors (MOSFETs) each having a drain terminal, a gate terminal, and a source terminal. The gate terminal of the first transistor QA and the gate terminal of the second transistor QB are connected to the first input terminal 154 so as to receive the first control signal therefrom. In some embodiments, an isolation and bias circuit 160 may be connected between the gate terminal of the first transistor QA and the first input terminal 154 so as to isolate the first control signal from high voltage, which may be present at the power converter-lamp output. The isolation and bias circuit 160 may, for example, be an isolation transformer with biasing circuitry or an opto-isolator with biasing circuitry. The drain terminal of the first transistor QA is connected to a first terminal of the capacitor C10, and the drain terminal of the second transistor QB is connected to a second terminal of the capacitor C10. The source terminals of the first and second transistors, QA and QB, are connected to ground potential.

Similarly, the second impedance circuit comprises a second input terminal 156, a second impedance component, such as but not limited to a capacitor C11, and a second switching network QC, QD. The second input terminal 156 is configured to receive the second control signal, which indicates the state of the second switch S2. The capacitor C11 (broadly, the second impedance component) is configured to connect in series with the plurality of lamps 106A, 106B when the plurality of lamps 106A, 106B are connected to the power converter 104. In some embodiments, a bleeder resistor R60 is connected in parallel with the capacitor C11. The second switching network is connected to the second input terminal 156 and is connected in parallel with the capacitor C11. In some embodiments, such as is shown in FIG. 1, the second switching network includes a third transistor QC and a fourth transistor QD. The third and fourth transistors, QC and QD, may be, but are not limited to, metal-oxide-semiconductor field-effect transistors (MOSFETs) each having a drain terminal, a gate terminal, and a source terminal. The gate terminal of the third transistor QC and the gate terminal of the fourth transistor QD are connected to the second input terminal 156 to receive the second control signal therefrom. In some embodiments, an isolation and bias circuit 162 may be connected between the gate terminal of the third transistor QC and the second input terminal 156 to isolate the second control signal from high voltage, which may be present at the power converter-lamp output. The isolation and bias circuit 162 may, for example, be an isolation transformer with biasing circuitry or an opto-isolator with biasing circuitry. The drain terminal of the third transistor QC is connected to a first terminal of the capacitor C11, and the drain terminal of the fourth transistor QD is connected to a second terminal of the capacitor C11. The source terminals of the third and fourth transistors, QC and QD, are connected to ground potential.

In operation, the first impedance circuit receives the first control signal via the first input terminal 154. For example, in some embodiments, the first control signal has a first logic level (e.g., low level, 0 volts) when the first switch S1 is non-conductive (e.g., OFF), and the first control signal also has a second logic level (e.g., high level, 10 volts) when the first switch S1 is conductive (e.g., ON). In some embodiments, at some time when the first control signal is at the first logic level, the first switching network (QA and QB) is non-conductive and the first impedance circuit provides a first impedance (e.g., capacitance value of the capacitor C10) in series with the plurality of lamps 106A, 106B. Alternatively, or additionally, the first impedance circuit may provide the first impedance at and/or near the instant when the first control signal changes to the first logic level. Alternatively, or additionally, the first impedance circuit may provide the first impedance after some period of time following the instant when the first control signal changes to the first logic level. On the other hand, at some when the first control signal is at the second logic level, the first switching network (QA and QB) is conductive, thereby short circuiting the capacitor C10. As such, the capacitor C10 is bypassed and the first impedance circuit does not introduce a first impedance (e.g., capacitance value of capacitor C10) in series with the plurality of lamps 106A, 106B. Alternatively, or additionally, the first impedance circuit may not provide the first impedance at and/or near the instant when the first control signal changes to the second logic level. Alternatively, or additionally, the first impedance circuit may not provide the first impedance after some period of time following the instant when the first control signal changes to the second logic level.

Similarly, the second impedance circuit receives the second control signal via the second input terminal 156. Like the first control signal, in some embodiments, the second control signal has a first logic level (e.g., low level, 0 volts) when the second switch S2 is non-conductive (e.g., OFF), and the second control signal has a second logic level (e.g., high level, 10 volts) when the second switch S2 is conductive (e.g., ON). Accordingly, in some embodiments, at some time when the second control signal is at the first logic level, the second switching network (QC and QD) is non-conductive and the second impedance circuit provides a second impedance (e.g., capacitance value of capacitor C11) in series with the plurality of lamps 106A, 106B. Alternatively, or additionally, the second impedance circuit may provide the second impedance at and/or near the instant when the second control signal changes to the first logic level. Alternatively, or additionally, the second impedance circuit may provide the second impedance after some period of time following the instant when the second control signal changes to the first logic level. On the other hand, at some time when the second control signal is at the second logic level, the second switching network (QC and QD) is conductive, thereby short circuiting the capacitor C11. As such, the capacitor C11 is bypassed and the second impedance circuit does not introduce a second impedance (e.g., capacitance value of capacitor C11) in series with the plurality of lamps 106A, 106B. Alternatively, or additionally, the second impedance circuit may not provide the second impedance at and/or near the instant when the second control signal changes to the second logic level. Alternatively, or additionally, the second impedance circuit may not provide the second impedance after some period of time following the instant when the first control signal changes to the second logic level.

Thus, when the first switch S1 is conductive (e.g., ON) and the second switch S2 is non-conductive (e.g. OFF), the first control signal is at the second logic level and the second control signal is at the first logic level. Accordingly, the first impedance circuit does not introduce a first impedance in series with the plurality of lamps 106A, 106B, and instead bypasses the first impedance component (e.g., the capacitor C10) from operating in series with the plurality of lamps 106A, 106B. However, the second impedance circuit introduces a second impedance in series with the plurality of lamps 106A, 106B. As such, a first voltage level is provided to the plurality of lamps 106A, 106B, and the plurality of lamps 106A, 106B operate at a first lighting level as a function of the first voltage level. The first voltage level is a function of the value of the total impedance, in this case the second impedance, which is added series with the lamps 106A, 106B by the impedance circuits. For example, the value of the second impedance component may be selected so that when it is introduced in series with the plurality of lamps 106A, 106B, the plurality of lamps 106A, 106B operate at 60 percent of the rated lamp current.

When the first switch S1 is non-conductive (e.g., OFF) and the second switch S2 is conductive (e.g., ON), the first control signal is the first logic level and the second control signal is the second logic level. Accordingly, the first impedance circuit introduces a first impedance in series with the plurality of lamps 106A, 106B. However, the second impedance circuit does not introduce a second impedance in series with the plurality of lamps 106A, 106B, and instead bypasses the second impedance component (e.g., the capacitor C11) from operating in series with the plurality of lamps 106A, 106B. As such, a second voltage level is provided to the plurality of lamps 106A, 106B, and the plurality of lamps 106A, 106B operate at a second lighting level as a function of the second voltage level. The second voltage level is a function of the value of the total impedance, in this case the first impedance, which is added in series with the plurality of lamps 106A, 106B by the impedance circuits. Thus, if the impedance value of the second impedance component is greater than the impedance value of the first impedance component, then the second voltage level will be greater than the first voltage level. For example, the value of the second impedance component may be selected so that when it is introduced in series with the plurality of lamps 106A, 106B, the plurality of lamps 106A, 106B operate at 80 percent of the rated lamp current.

When the first switch S1 and the second switch S2 are both conductive (e.g., ON), the first control signal and the second control signal both are at the second logic level. Accordingly, neither the first nor the second impedance circuits introduce impedance in series with the plurality of lamps 106A, 106B. Instead, the first impedance circuit bypasses the first impedance component (e.g., the capacitor C10), and the second impedance circuit likewise bypasses the second impedance component (e.g., the capacitor C11) from operating in series with the plurality of lamps 106A, 106B. As such, a third voltage level is provided to the plurality of lamps 106A, 106B, and the plurality of lamps 106A, 106B operate at a third lighting level as a function of the third voltage level. The third voltage level is a function of the value of the total impedance, which in this case is none, that is added in series with the plurality of lamps 106A, 106B by the impedance circuits. Since no impedance is added in series with the plurality of lamps 106A, 106B by the impedance circuits, the plurality of lamps 106A, 106B operate at full brightness (e.g., 100 percent of rated lamp current). When the first switch S1 and the second switch S2 are both non-conductive (e.g., OFF), no voltage is provided to the plurality of lamps 106A, 106B.

Figure 2:
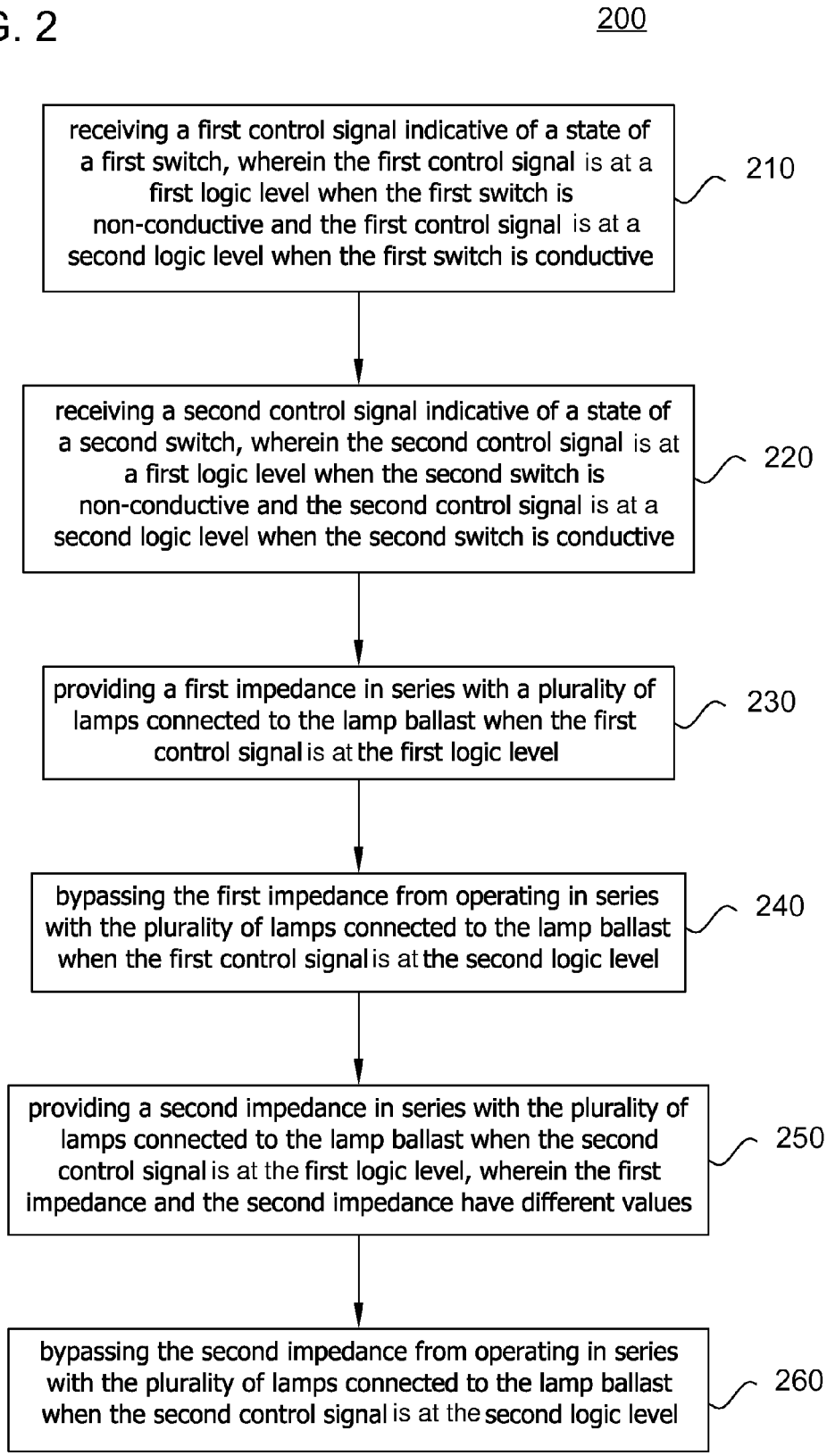
FIG. 2 is a block diagram of a method performed by a lighting system converter circuit of a power converter according to embodiments disclosed herein.

In accordance with the above description, FIG. 2 is a block diagram illustrating the operations of a method 200 performed by the first and second impedance circuits of the lighting system converter circuit 130. At 210, the first control signal is received and is indicative of the state of the first switch S1. The first control signal has a first logic level when the first switch S1 is non-conductive and the first control signal has a second logic level when the first switch S1 is conductive. Similarly, at 220, the second control signal is received and is indicative of the state of the second switch S2. The second control signal has a first logic level when the second switch S2 is non-conductive and the second control signal has a second logic level with the second switch S2 is conductive. A first impedance is provided in series with the plurality of lamps 106A, 106B at 230 when the first control signal is at the first logic level. In contrast, the first impedance is bypassed from operating in series with the plurality of lamps 106A, 106B at 240 when the first control signal it at the second logic level. Likewise, a second impedance is provided in series with the lamps plurality of 106A, 106B at 250 when the second control signal is at the first logic level. The second impedance is bypassed from operating in series with the plurality of lamps 106A, 106B at 260 when the second control signal is at the second logic level.

Figure 3A:
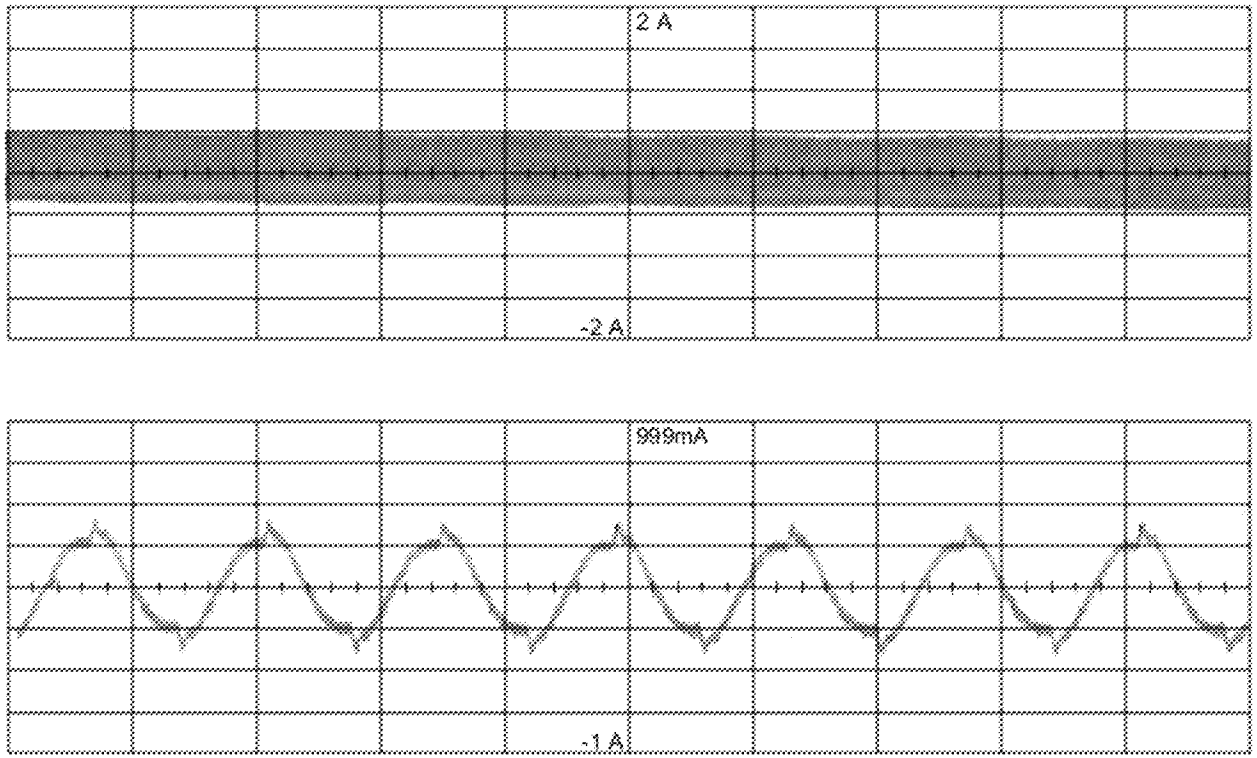
FIGS. 3A, 3B, and 3C illustrate various waveforms resulting from the control signals and the states of the switches corresponding to those control signals, according to embodiments disclosed herein.
Figure 3B:
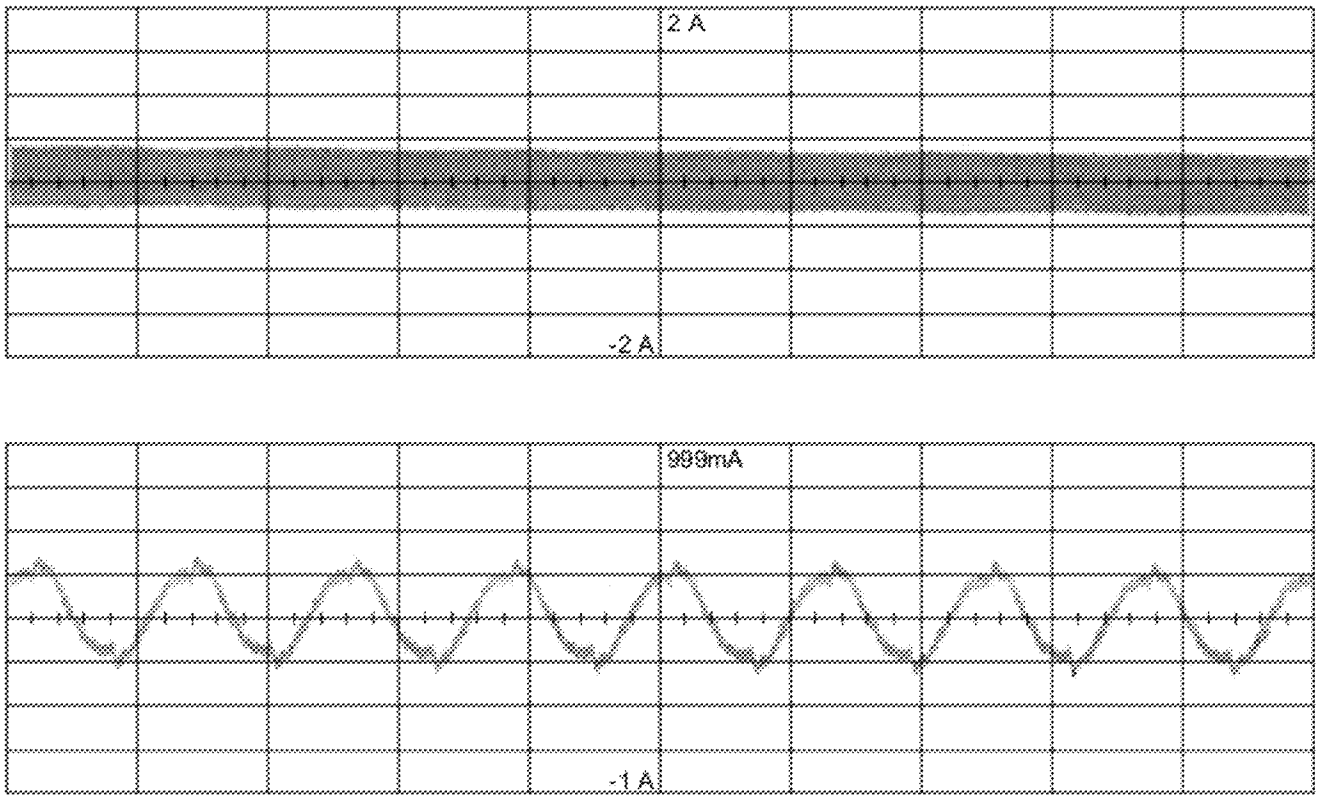
Figure 3C:
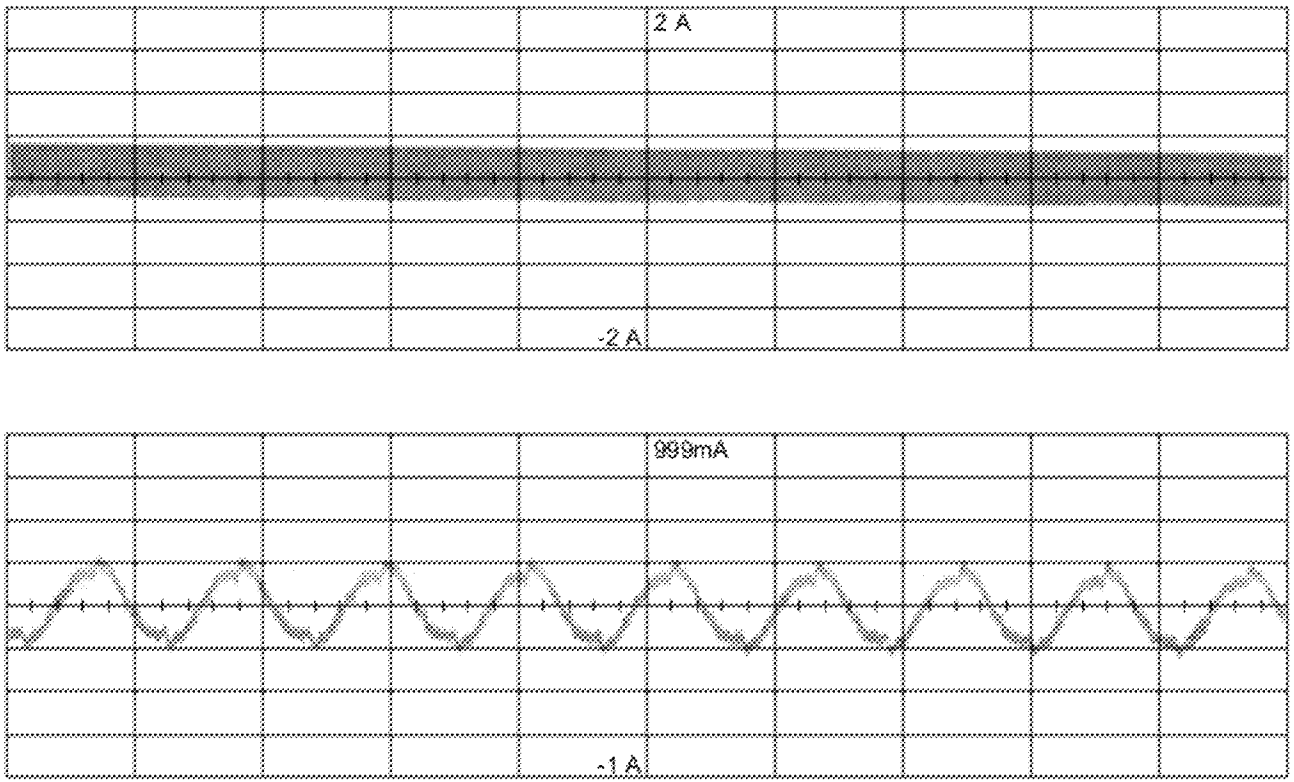

FIGS. 3A, 3B, and 3C all illustrate various waveforms (i.e., current and/or voltage) with respect to various statuses of the first switch S1 and/or the second switch S2. FIG. 3A shows waveforms indicative of a current through at least one of the plurality of lamps 106A, 106B, when both the first switch S1 and the second switch S2 are conductive (i.e., the first switch S1 has a first status, and the first status of the first switch S1 is that the first switch S1 is ON; the second switch S2 has a first status, and the first status of the second switch S2 is that the second switch S2 is ON). This corresponds to, for example, a full brightness (i.e., light/lumen output) level of the plurality of lamps 106A, 106B. FIG. 3B shows waveforms indicative of a current through at least one of the plurality of lamps 106A, 106B, when the first switch S1 is conductive and the second switch S2 is non-conductive (i.e., the first switch S1 has the first status, which is that the first switch S1 is ON; the second switch S2 has a second status, and the second status of the second switch S2 is that the second switch S2 is OFF). This corresponds to, for example, a first dimming level of the plurality of lamps 106A, 106B, where the plurality of lamps 106A, 106B are generating something less than a full brightness (i.e., light/lumen output) level. FIG. 3C shows waveforms indicative of a current through at least one of the plurality of lamps 106A, 106B, when the first switch S1 is non-conductive and the second switch S2 is conductive (i.e., the first switch S1 has a second status, and the second status of the first switch S1 is that the first switch S1 is OFF; the second switch S2 has the second status, which is that the second switch S2 is OFF). This corresponds to, for example, a second dimming level of the plurality of lamps 106A, 106B, where the plurality of lamps 106A, 106B are generating something less than a full brightness (i.e., light/lumen output) level. In some embodiments, the first dimming level and the second dimming level are the same, while in other embodiments, the first dimming level and the second dimming level are different.

Thus, as described above, the lighting system converter circuit 130 controls a voltage level provided to the plurality of lamps 106A, 106B as a function of the first and second control signals to operate the plurality of lamps 106A, 106B at multiple lighting levels.

Embodiments of the present invention have been described above in connection with a first and second switch, a first and second control signal, and a first and second impedance circuit. However, it should be noted that additional switches and corresponding control signals and impedance circuits may be included in the power converter so that the plurality of lamps 106A, 106B may be operated at additional lighting levels.

Further, though components (e.g., the first and second switching networks) have been described herein using analog components, the functionality of any/all of these may, in some embodiments, be performed using a combination of hardware (i.e., a microcontroller) and software (i.e., instructions stored within a memory element, either within the microcontroller or external to it, that are executed by the microcontroller) to replicate the same functionality of any of the analog elements, without departing from the scope of the invention.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s) (e.g., Sun, HP), personal digital assistant(s) (PDA(s)), handheld device(s) such as cellular telephone(s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor" and "a microcontroller", or "the microprocessor" and "the processor" and "the microcontroller", may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A lighting system converter circuit to selectively operate a plurality of lamps connected to a lamp power converter, wherein the lamp power converter includes the lighting system converter circuit, the lighting system converter circuit comprising:

a first impedance circuit comprising:

a first input terminal configured to receive a first control signal, wherein the first control signal indicates a state of a first switch, and wherein the first control signal has a first logic level and a second logic level, wherein the first logic level corresponds to the first switch being non-conductive and the second logic level corresponds to the first switch being conductive;

a first impedance component configured to connect in series with the plurality of lamps; and a first switching network connected to the first input terminal and in parallel with the first impedance component, wherein the first switching network is configured to selectively operate between a conductive state and a non-conductive state as a function of the logic level of the first control signal, wherein the first switching network comprises:

a first transistor having a drain terminal, a gate terminal, and a source terminal; and a second transistor having a drain terminal, a gate terminal, and a source terminal;

wherein the gate terminal of the first transistor and the gate terminal of the second transistor are connected to the first input terminal of the first impedance circuit to receive the first control signal therefrom; and wherein the drain terminal of the first transistor is connected to a first terminal of the first impedance component and the drain terminal of the second transistor is connected to a second terminal of the first impedance component; and a second impedance circuit comprising:

a second input terminal configured to receive a second control signal, wherein the second control signal indicates a state of a second switch, and wherein the second control signal has a first logic level and a second logic level, wherein the first logic level corresponds to the second switch being non-conductive and the second logic level corresponds to the second switch being conductive;

a second impedance component configured to connect in series with the plurality of lamps; and a second switching network connected to the second input terminal and in parallel with the second impedance component, wherein the second switching network is configured to selectively operate between a conductive state and a non-conductive state as a function of the logic level of the second control signal, wherein the second switching network comprises:

a third transistor having a drain terminal, a gate terminal, and a source terminal; and a fourth transistor having a drain terminal, a gate terminal, and a source terminal;

wherein the gate terminal of the third transistor and the gate terminal of the fourth transistor are connected to the second input terminal to receive the second control signal therefrom; and wherein the drain terminal of the third transistor is connected to a first terminal of the second impedance component and the drain terminal of the fourth transistor is connected to a second terminal of the second impedance component.

2. The lighting system converter circuit of claim 1, wherein the first switching network is configured to operate in a conductive state when the first control signal is at the second logic level, and to operate in a non-conductive state when the first control signal is at the first logic level.

3. The lighting system converter circuit of claim 1, wherein the second switching network is configured to operate in a conductive state when the second control signal is at the second logic level, and to operate in a non-conductive state when the second control signal is at the first logic level.

4. The lighting system converter circuit of claim 1, wherein the first and second impedance components comprises one or more capacitors.

5. The lighting system converter circuit of claim 1, wherein the first impedance component has a first impedance value and the second impedance component has a second impedance value, and wherein the second impedance value is greater than the first impedance value.

6. The lighting system converter circuit of claim 5, wherein the lighting system converter circuit is configured to provide a first voltage level to energize the plurality of lamps when the first switching component is conductive and the second switching component is non-conductive, and wherein the lighting system converter circuit is configured to provide a second voltage level to energize the plurality of lamps when the first switching component is non-conductive and the second switching component is conductive, and wherein the second voltage level being greater than the first voltage level.

7. The lighting system converter circuit of claim 5, wherein the lighting system converter circuit is configured to provide a first voltage level to energize the plurality of lamps when the first control signal is at the second logic level and the second control signal is at the first logic level, and wherein the lighting system converter circuit is configured to provide a second voltage level to energize the plurality of lamps when the first control signal is at the first logic level and the second control signal is at the second logic level, and wherein the second voltage level is greater than the first voltage level.

8. The lighting system converter circuit of claim 1, wherein the lighting system converter circuit is configured to operate the plurality of lamps at maximum brightness when the first switching component is conductive and the second switching component is conductive.

9. The lighting system converter circuit of claim 1, wherein the lighting system converter circuit is configured to operate the plurality of lamps at maximum brightness when the first control signal is at the second logic level and the second control signal is at the second logic level.

10. The lighting system converter circuit of claim 1, wherein a first isolation transformer with biasing circuitry is connected between the first input terminal and the first switching network, and wherein a second isolation transformer with biasing circuitry is connected between the second input terminal and the second switching network.

11. The lighting system converter circuit of claim 1, wherein a first opto-isolator with biasing circuitry is connected between the first input terminal and the first switching network, and wherein a second opto-isolator with biasing circuitry is connected between the second input terminal and the second switching network.

12. A lamp power converter to power a plurality of lamps connected thereto from an alternating current (AC) power supply, the lamp power converter comprising:

a first switch adapted to selectively connect the lamp power converter to a first high voltage terminal of the AC power supply, the first switch having an on state and an off state;

a second switch adapted to selectively connect the lamp power converter to a second high voltage terminal of the AC power supply, the second switch having an on state and an off state;

a switch control circuit to generate a first control signal and a second control signal, wherein the first control signal indicates a status of the first switch, and wherein the second control signal indicates a status of the second switch; and a lighting system converter circuit configured to provide a first impedance in series with the plurality of lamps when the first control signal indicates a first status of the first switch, and to provide a second impedance in series with the plurality of lamps when the second control signal indicates a first status of the second switch, wherein the lighting system converter circuit comprises:

a first impedance circuit comprising:

a first input terminal configured to receive the first control signal from the switch control circuit;

a first impedance component configured to connect in series with the plurality of lamps; and a first switching network connected to the first input terminal and in parallel with the first impedance component, wherein the first switching network is configured to selectively operate between a conductive state and a non-conductive state as a function of the status of the first switch as indicated by the first control signal; and a second impedance circuit comprising:

a second input terminal configured to receive the second control signal from the switch control circuit;

a second impedance component configured to connect in series with the plurality of lamps; and a second switching network connected to the second input terminal and in parallel with the second impedance component, wherein the second switching network is configured to selectively operate between a conductive state and a non-conductive state as a function of the status of the second switch as indicated by the second control signal; and wherein the lighting system converter circuit further comprises:

a first isolation and bias circuit connected between the switch control circuit and the first switching network; and a second isolation and bias circuit connected between the switch control circuit and the second switching network.

13. The lamp power converter of claim 12 wherein the lighting system converter circuit is configured to provide a first voltage level to the plurality of lamps when the first control signal indicates a second status of the first switch and the second control signal indicates the first status of the second switch, and to provide a second voltage level to the plurality of lamps when the first control signal indicates the first status of the first switch and the second control signal indicates a second status of the second switch, wherein the second voltage level is greater than the first voltage level.

* * * * *